United States Patent [19]

Feltman et al.

[11] 4,170,120

[45] Oct. 9, 1979

[54] SIMULATED DEAD BOLT LOCK FOR DETERRING BURGLARS

[76] Inventors: Murray Feltman, 76-6246 Alii Dr., #226, Kailua-Kona, Hi. 96740; David L. Fields, 6843 43rd NE., Seattle, Wash. 98115

[21] Appl. No.: 888,772

[22] Filed: Mar. 21, 1978

[51] Int. Cl.[2] ..... E05B 17/00

[52] U.S. Cl. ..... 70/431; 70/DIG. 81

[58] Field of Search ..... 70/416, 417, 381, 431, 70/447, 452, 454, 455, DIG. 81

[56] References Cited

U.S. PATENT DOCUMENTS

| | | | |
|---|---|---|---|
| 393,648 | 11/1888 | Hughes | 70/452 |
| 2,563,950 | 8/1951 | Martin | 70/454 |
| 3,613,410 | 10/1971 | Shaw | 70/202 |
| 3,736,781 | 6/1973 | Foote | 70/456 R |
| 4,084,417 | 4/1978 | Daniel | 70/431 |

*Primary Examiner*—Robert L. Wolfe

*Attorney, Agent, or Firm*—Christensen, O'Connor, Johnson & Kindness

[57] ABSTRACT

This apparatus simulates the appearance of an actual dead bolt lock. When installed, the simulated dead bolt lock discourages would-be vandals from attempting to break into homes or businesses. The simulated dead bolt lock is installed on a door and includes a collar fastened to the door so that the collar resists rotation when fastened. The collar has a back surface, beveled side surfaces and a front surface. A recess is formed in the front surface of the collar to receive a keyway insert. The keyway insert has a keyhole, and is permanently secured within the recess on the front surface of the collar.

5 Claims, 4 Drawing Figures

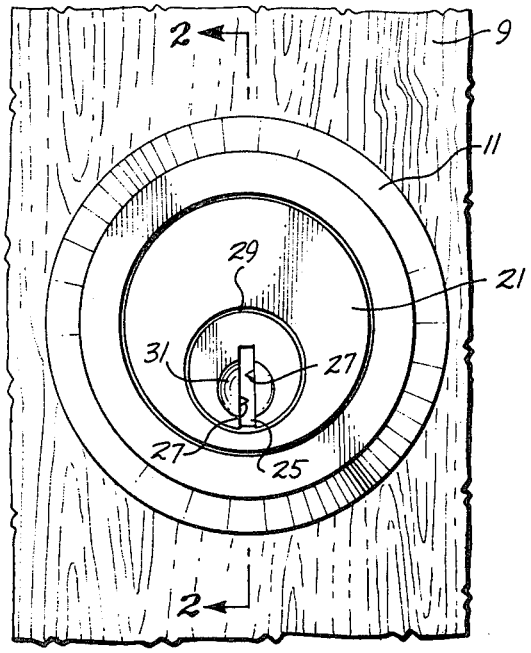
Fig. 1
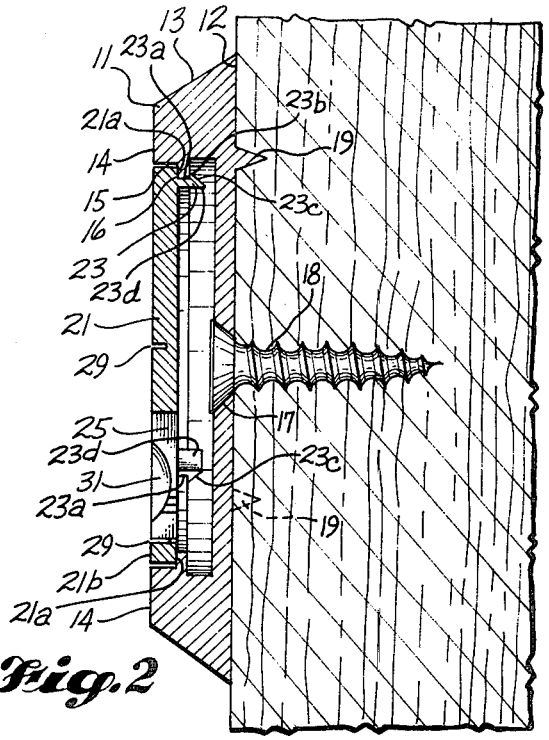
Fig. 2
Fig. 3
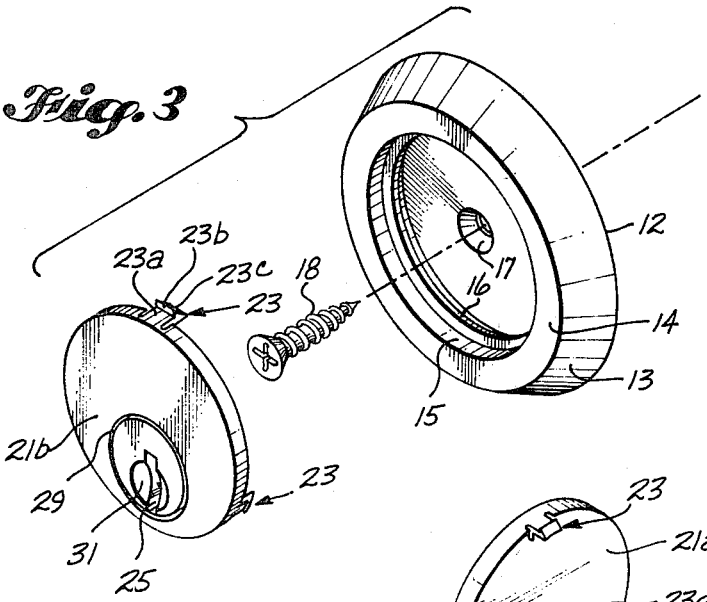
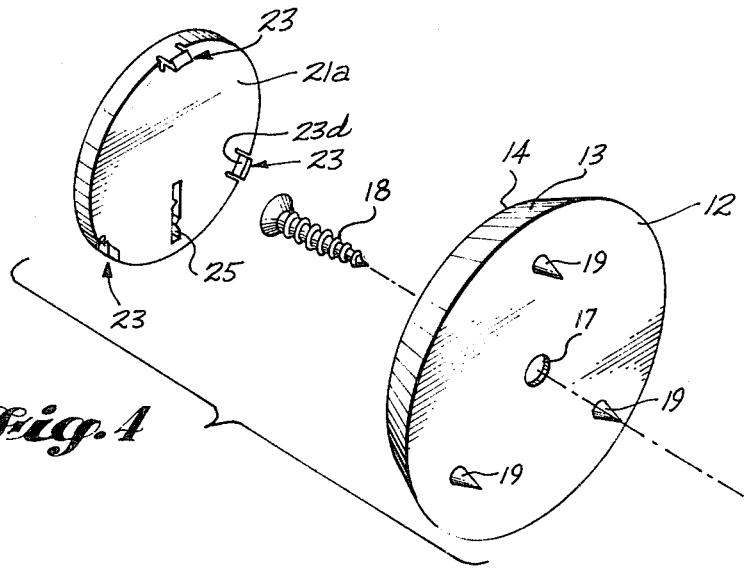
Fig. 4

SIMULATED DEAD BOLT LOCK FOR DETERRING BURGLARS

BACKGROUND OF THE INVENTION

This invention is directed to an apparatus which increases security and, more particularly, to a simulated dead bolt lock.

In reaction to a steady increase in the number of burglaries, the public has sought devices which will afford greater security for their homes and businesses. One of the most well-recognized high security devices has been the dead bolt lock. However, the dead bolt lock has become rather expensive. It is also fairly sophisticated in its design and construction, which makes it difficult to install, usually requiring special skills. Therefore, a person who seeks to obtain the additional security afforded by a dead bolt lock has an initial expense of purchasing the lock, plus the expense of having it installed.

It is an object of this invention to provide a security device that is easily mass manufactured at a low unit cost that simulates the appearance of an actual dead bolt lock so as to deter burglars and vandals from breaking into homes and businesses.

It is another object of this invention to provide a simulated dead bolt lock that is easy to install, and that is difficult to remove once installed.

SUMMARY OF THE INVENTION

This apparatus simulates the appearance of an actual dead bolt lock. The device is installed on a door, and includes a collar having a back surface, beveled side surfaces and a front surface. The back surface is affixed to the door in a manner that prevents the collar from being rotated once installed. The front surface of the collar has a recess shaped to receive a keyway insert. The keyway insert, which includes a keyhole, fits snuggly and is retained within the recess of the collar.

With reference to further aspects of this invention, the keyway insert is permanently held within the recess of the collar by a series of clips to provide a tight snap-in installation. Once installed, the keyway insert has a front surface that is substantially coplanar with the exposed front surface of the collar.

From the foregoing description, it will be appreciated that the simulated dead bolt lock is easily manufactured and simple to install. Yet, once installed, the simulated dead bolt lock is difficult to remove.

BRIEF DESCRIPTION OF THE DRAWINGS

The foregoing objects and many of the attendant advantages of this invention will become more readily appreciated by reference to the following detailed description and the accompanying drawings.

FIG. 1 is a front elevation view of a preferred embodiment of the invention;

FIG. 2 is a cross-sectional view taken along line 2—2 of FIG. 1;

FIG. 3 is an exploded perspective view illustrating the front surfaces of a preferred embodiment of the invention; and FIG. 4 is an exploded perspective view illustrating the back surfaces of a preferred embodiment of the invention.

DESCRIPTION OF THE PREFERRED EMBODIMENT

The preferred embodiment of this invention, illustrated in FIGS. 1–4, simulates the exterior appearance of an actual dead bolt lock. In essence, the apparatus is a false dead bolt lock designed and configured to deceive burglars and vandals into believing that it represents the real device, thereby discouraging would-be burglars and vandals from attempting to break into dwellings, offices or other buildings or compartments.

As shown in FIG. 1, the apparatus generally includes a collar 11 fastened to a door 9. Centrally mounted within a recess 15 of collar 11 is a keyway insert 21. The keyway insert 21 includes a standard keyway opening 25. As viewed in FIG. 1, the apparatus is substantially identical to an actual dead bolt lock.

As illustrated in FIGS. 2–4, it is clear that the apparatus only simulates an actual dead bolt lock. No actual locking mechanism is included. The collar 11 is a solid member of circular shape and has a flat, back surface 12 so as to make contiguous contact with the planar surface of a door 9. The back surface 12 of collar 11 parallels the exposed flat surface of a door 9. Any spacing between the back surface 12 of collar 11, at least at its outer perimeter, and the front surface of the door 9 would permit the collar 11 to be pried away from the door 9 with a tool such as a screwdriver.

The side surfaces 13 of collar 11 are sized and shaped to prevent easy gripping of the collar with a tool such as a wrench or pliers. In the preferred embodiment, the sides 13 of collar 11 are beveled inwardly, from the back surface 12 to the front surface 14.

The front surface 14 of collar 11 is generally planar and is parallel to the back surface 12. As shown in FIGS. 2 and 3, a portion of the front surface 14 of collar 11 is formed with a concentrically located cylindrical recess 15. A retaining flange 16, integral with collar 11, projects radially inwardly from the sides of recess 15. The retaining flange 16 is spaced rearwardly from the front surface 14 of collar 11 by a predetermined distance to receive the thickness of the keyway insert 21, and is spaced forwardly from the innermost or back surface of recess 15 to accommodate a plurality of retaining clips 23. A countersunk opening 17 extends through collar 11 to the back surface 12, and receives wood screw 18 for fastening the collar 11 to door 9. The tapered screwhead of screw 18 fits tightly in the countersunk opening 17 of collar 11 to securely hold it in place against the door 9. Additionally, a plurality of pointed studs 19 project orthogonally from the back surface 12 of collar 11. The pointed studs 19 are forced into the door 9 during installation of the simulated dead bolt lock to prevent rotation of the collar subsequent to installation.

The cylindrical keyway insert 21 fits snuggly within the recess 15 of collar 11. The perimeter of the back surface **21*a* of keyway insert 21 abuts against the retaining flange 16 such that the front surface 21*b* of keyway insert 21 is substantially coplanar with the front surface 14 of collar 11. The keyway insert 21 is retained in the recess 15 of collar 11 by the plurality of retaining clips 23 which are spaced circumferentially about the perimeter of keyway insert 21 and project rearwardly therefrom. The outward surface of each retaining clip includes three surfaces; a rearward surface 23*a*, a catching surface 23*b* and a tapered surface 23*c*. Each clip also has a single, rearward extending inner surface 23*d*. The rearward surface 23*a* is parallel with and abuts the inner surface of retaining flange 16. The catching surface 23***b* extends outwardly orthogonal from the rearward surface and abuts the rearward surface of retaining flange 16 to prevent the keyway insert 21 from being removed from the collar 11. The tapered surface 23*c* of clip 23 tapers inwardly and rearwardly from the catching surface 23*b*, coming to a point where it intersects with the rearward extending inner surface 23*d*.

The keyway insert also includes design features that simulate the construction of an actual dead bolt lock. Specifically, keyway opening 25 is vertically elongate and has key teeth 27, visible from the front of the lock, that project inwardly from the sides of the keyway opening 25. A circular indentation 29, eccentrically located on keyway insert 21, surrounds opening 25 to simulate the rotatable cylinder of an actual dead bolt lock. Additionally, semicircular, concave cutout portions 31 are provided on opposed sides of keyway opening 25.

Installation of the preferred embodiment of the invention onto a door is extremely easy. The collar 11 is positioned on the door 9. Pressure is exerted on the front of collar 11 so that the studs 19 penetrate into the wooden door 9 to hold the collar in position. Screw 18 is then inserted into opening 17 and tightened to the door so that the tapered screwhead seats in the countersink of the opening 17. Collar 11 is thereby securely and nonrotatably fastened to the door. The keyway insert 21 is then placed within recess 15 of collar 11 such that the tapered surface 23*c* of the clips 23 contact the retaining flange 16 of collar 11. The keyway insert 21 is then rotated to its correct position and pressure is exerted on the front surface of the keyway insert 21 until clips 23 snap into place, with catch surfaces 23*b* contacting the rearward surface of the retaining flange 16.

It will be appreciated from the foregoing description that the preferred embodiment of the invention provides an easily mass manufactured security apparatus at a low unit cost, that is easy to install. The apparatus simulates the appearance of an actual dead bolt lock. The device is virtually tamper proof because all of the fastening mechanisms are hidden and inaccessible.

While a preferred embodiment of the invention has been illustrated and described, it will be appreciated by those skilled in the art and others that various changes can be made thereto without departing from the spirit of the invention. For example, the collar may be fastened to a door by various mechanisms, such as an adhesive, or plastic or metal device inset into the door for receiving a screw or bolt. Additionally, the keyway insert may be retained within the cylindrical recess by a variety of mechanisms including, but not limited to, projections extending from the side of the keyway insert which nonresiliently deform when the keyway insert is pressed into the cylindrical recess; adhesive; or any self-tapping or self-locking mechanisms. Hence, the invention can be practiced otherwise than as specifically described herein without departing from the spirit and the scope of the invention.

The embodiments of the invention in which an exclusive property or privilege is claimed are defined as follows:

1. A simulated dead bolt lock capable of being installed on a door comprising:

a collar having a back surface, beveled side surfaces and a front surface, said front surface being formed with a recess for receiving a keyway insert therein;

means disposed within said recess for fastening said collar to said door with said back surface in contact with such door, and means for resisting rotation of said collar when so fastened to such door;

a keyway insert shaped so as to be received within said recess in said front surface of said collar and including means defining a keyhole, said keyway insert when received within said recess acting to cover and thereby hide said means for fastening said collar to said door; and retaining means associated with said keyway insert and said collar for permanently and nonrotatably securing said keyway insert within said recess of said collar.

2. The simulated dead bolt lock of claim 1 wherein said back surface of said collar is planar for lying flat against the surface of said door and extends across that area of said collar lying behind said recess.

3. A simulated dead bolt lock capable of being installed on a door comprising:

a collar having a back surface, beveled side surfaces and a front surface, said front surface being formed with a recess for receiving a keyway insert therein;

means for fastening said collar to said door with said back surface in contact with such door, and means for resisting rotation of said collar when so fastened to such door;

a keyway insert shaped so as to be received within said recess in said front surface of said collar, said keyway insert including means defining a keyhole; and retaining means associated with said keyway insert and said collar and including a plurality of projections extending from the sides of said keyway insert for permanently securing said keyway insert within said recess of said collar.

4. The simulated dead bolt lock of claim 3 including means associated with said recess of said collar for receiving said plurality of projections.

5. The deceptive lock of claim 4 wherein said means for resisting rotation of said collar includes a plurality of studs extending from said back surface of said collar.

* * * * *